US008741534B2

(12) United States Patent
Ou et al.

(10) Patent No.: US 8,741,534 B2
(45) Date of Patent: Jun. 3, 2014

(54) EFFICIENT SOLVENT-BASED PHASE INVERSION EMULSIFICATION PROCESS WITH DEFOAMER

(75) Inventors: Zhaoyang Ou, Webster, NY (US); Robert D. Bayley, Fairport, NY (US); Zhen Lai, Webster, NY (US); Rashid Mahmood, Mississauga (CA); David R. Kurceba, Hamilton (CA); John Abate, Mississauga (CA); Shigang Qiu, Toronto (CA); Chieh-Min Cheng, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 671 days.

(21) Appl. No.: 12/480,058

(22) Filed: Jun. 8, 2009

(65) Prior Publication Data

US 2010/0310979 A1 Dec. 9, 2010

(51) Int. Cl.
*G03G 5/00* (2006.01)

(52) U.S. Cl.
USPC ..... 430/137.17; 430/137.1

(58) Field of Classification Search
USPC ..... 430/108.2, 108.4, 109.3, 137.1, 137.15, 430/137.17
See application file for complete search history.

(56) References Cited

U.S. PATENT DOCUMENTS

| | | | | |
|---|---|---|---|---|
| 3,590,000 | A | 6/1971 | Palermiti et al. | |
| 3,963,627 | A * | 6/1976 | Cottrell | 252/4 |
| 4,298,672 | A | 11/1981 | Lu | |
| 4,338,390 | A | 7/1982 | Lu | |
| 5,278,020 | A | 1/1994 | Grushkin et al. | |
| 5,290,654 | A | 3/1994 | Sacripante et al. | |
| 5,302,486 | A | 4/1994 | Patel et al. | |
| 5,308,734 | A | 5/1994 | Sacripante et al. | |
| 5,344,738 | A | 9/1994 | Kmiecik-Lawrynowicz et al. | |
| 5,346,797 | A | 9/1994 | Kmiecik-Lawrynowicz et al. | |
| 5,348,832 | A | 9/1994 | Sacripante et al. | |
| 5,364,729 | A | 11/1994 | Kmiecik-Lawrynowicz et al. | |
| 5,366,841 | A | 11/1994 | Patel et al. | |
| 5,370,963 | A | 12/1994 | Patel et al. | |
| 5,403,693 | A | 4/1995 | Patel et al. | |
| 5,405,728 | A | 4/1995 | Hopper et al. | |
| 5,418,108 | A | 5/1995 | Kmiecik-Lawrynowicz et al. | |
| 5,496,676 | A | 3/1996 | Croucher et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,723,253 | A | 3/1998 | Higashino et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,943 | A | 12/1998 | Cheng et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 5,994,020 | A | 11/1999 | Patel et al. | |
| 6,063,827 | A | 5/2000 | Sacripante et al. | |
| 6,214,507 | B1 | 4/2001 | Sokol et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,776,994 | B2 * | 8/2010 | Mera et al. | 528/272 |
| 2005/0048392 | A1 | 3/2005 | Tanaka | |
| 2006/0160921 | A1 * | 7/2006 | Ragone et al. | 523/122 |
| 2006/0222991 | A1 | 10/2006 | Sacripante et al. | |
| 2007/0010612 | A1 | 1/2007 | Rouge et al. | |
| 2007/0088117 | A1 | 4/2007 | Zhou et al. | |
| 2007/0299074 | A1 * | 12/2007 | Netz et al. | 514/236.8 |
| 2008/0107989 | A1 | 5/2008 | Sacripante et al. | |
| 2008/0153027 | A1 | 6/2008 | Veregin et al. | |
| 2008/0236446 | A1 | 10/2008 | Zhou et al. | |
| 2008/0262057 | A1 * | 10/2008 | Tisdell et al. | 514/378 |
| 2009/0053644 | A1 | 2/2009 | Sacripante | |
| 2009/0233216 | A1 * | 9/2009 | Teshima | 430/115 |

OTHER PUBLICATIONS

U.S. Appl. No,: 12/032,173, filed Feb. 15, 2008.
U.S. Appl. No. 12/056,529, filed Mar. 27, 2008.

* cited by examiner

*Primary Examiner* — Stewart Fraser
(74) *Attorney, Agent, or Firm* — MDIP LLC

(57) ABSTRACT

A process and system for making a resin emulsion suitable for use in forming toner particles including a silicone free anti-foam agent to control foam during formation of a polyester dispersion.

10 Claims, No Drawings

EFFICIENT SOLVENT-BASED PHASE INVERSION EMULSIFICATION PROCESS WITH DEFOAMER

TECHNICAL FIELD

The present disclosure relates to processes for producing resin emulsions useful in producing toners. More specifically, the present disclosure relates to energy efficient processes for solvent stripping in phase inversion emulsification of polyester resins utilizing an anti-foam agent.

BACKGROUND

Numerous processes are within the purview of those skilled in the art for the preparation of toners. Emulsion aggregation (EA) is one such method. Emulsion aggregation toners may be used in forming print and/or xerographic images. Emulsion aggregation techniques may involve the formation of an emulsion latex of the resin particles by heating the resin using a batch or semi-continuous emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,902,710; 5,910,387; 5,916,725; 5,919,595; 5,925,488, 5,977,210, 5,994,020, and U.S. Patent Application Publication No. 2008/01017989, the disclosures of each of which are hereby incorporated by reference in their entirety.

Polyester EA ultra low melt (ULM) toners have been prepared utilizing amorphous and crystalline polyester resins as illustrated, for example, in U.S. Patent Application Publication No. 2008/0153027, the disclosure of which is hereby incorporated by reference in its entirety. The incorporation of these polyesters into the toner generally requires that they first be formulated into latex emulsions prepared by solvent containing batch processes, for example solvent flash emulsification and/or solvent-based phase inversion emulsification (PIE), which is time and energy-consuming.

In PIE, polyester resins may be converted into an aqueous dispersion by dissolving the polyester resin in at least one organic solvent which then needs to be removed, sometimes referred to as skipped, via a vacuum distillation process for safety and environmental concerns. However, due to both the presence of large amounts of solvents and a detrimental foaming phenomenon, i.e. formation of thick and long-life foam inside the distillation reactor, solvent stripping has become a very energy-intense and time-consuming step in PIE and can lead to product loss. For example, in a 300-gallon scale production, it takes about 6 hours and mild temperatures to produce the polyester dispersion whereas solvent stripping can take up to 30 hours under high temperature and high vacuum. To prevent any foam from boiling over (product loss), reactor vacuum level and temperature may be dropped to the point where solvent stripping efficiency is extremely slow.

Accordingly, it would be advantageous to provide a process for the preparation of a polyester dispersion suitable for use in a toner product that is more efficient, takes less time, with foam control, and results in a consistent toner product.

SUMMARY

A toner is provided including at least one polyester resin in an organic solvent; a solvent inversion agent; a neutralizing agent; a silicone-free anti-foam agent; and one or more additional ingredients of a toner composition.

The present disclosure describes a process which includes contacting at least one polyester resin possessing acid groups with an organic solvent to form a resin mixture; heating the resin mixture to a desired temperature; adding at least one solvent inversion agent to the mixture; neutralizing the resin mixture with a neutralizing agent; and introducing a silicone-free anti-foam agent to the resin mixture.

In another aspect of the present disclosure, a process is provided which includes contacting at least one polyester resin with an organic solvent to form a mixture; heating the mixture to a desired temperature; diluting the mixture to a desired concentration by adding at least one solvent inversion agent to form a diluted mixture; mixing an aqueous solution of neutralizing agent with the diluted mixture; adding water dropwise to the diluted mixture until phase inversion occurs to form a phase inversed mixture; adding a silicone-free anti-foam agent in incremental amounts to the phase inversed mixture; and removing the solvents from the phase inversed mixture.

DETAILED DESCRIPTION

Previous disclosures cited above describe processes for making a polyester dispersion with PIE. However, the production of these dispersions by PIE, utilizing an efficient solvent stripping process without the formation of thick and long-life foam, have not been explored.

The present disclosure includes using a defoaming agent, sometimes also referred to herein as an anti-foam agent, for a more efficient solvent-based phase inversion emulsification of polyesters. These polyesters, in turn, may be utilized for the preparation of ultra low melt polyester toners. The present disclosure provides processes for forming a polyester dispersion with less foaming and product loss, and lower distillation times. In embodiments, a toner of the present disclosure may include at least one polyester resin in an organic solvent; a solvent inversion agent; a neutralizing agent; a silicone-free anti-foam agent; and one or more additional ingredients of a toner composition.

In embodiments, a process of the present disclosure may include contacting at least one polyester resin possessing acid groups with an organic solvent to form a resin mixture; heating the resin mixture to a desired temperature; adding at least one solvent inversion agent to the mixture; neutralizing the resin mixture with a neutralizing agent; and introducing a silicone-free anti-foam agent to the resin mixture.

The present disclosure also provides processes for producing a polyester dispersion for use in making a toner. In embodiments, a process of the present disclosure includes contacting at least one polyester resin with an organic solvent to form a mixture; heating the mixture to a desired temperature; diluting the mixture to a desired concentration by adding at least one solvent inversion agent to form a diluted mixture; mixing an aqueous solution of neutralizing agent with the diluted mixture; adding water dropwise to the diluted mixture until phase inversion occurs to form a phase inversed mixture; adding a silicone-free anti-foam agent in incremental amounts to the phase inversed mixture; and removing the solvents from the phase inversed mixture.

Resins

Any resin may be utilized in the present disclosure. In embodiments, the resins may be an amorphous resin, a crystalline resin, and/or a combination thereof. In further embodiments, the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like including their structural isomers. The aliphatic diol may be, for example, selected in an amount of from about 40 to about 60 mole percent, in embodiments from about 42 to about 55 mole percent, in embodiments from about 45 to about 53 mole percent, and a second diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, in embodiments from about 40 to about 60 mole percent, in embodiments from about 42 to about 52 mole percent, in embodiments from about 45 to about 50 mole percent, and a second diacid can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate). Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly (propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

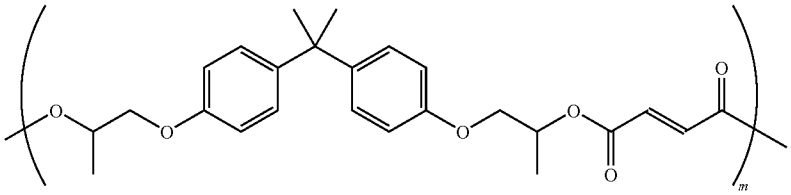

(I)

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

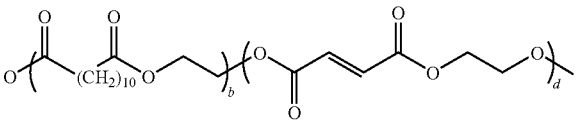

(II)

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a latex emulsion.

The amorphous resin may be present, for example, in an amount of from about 30 to about 90 percent by weight of the toner components, in embodiments from about 40 to about 80 percent by weight of the toner components. In embodiments, the amorphous resin or combination of amorphous resins utilized in the latex may have a glass transition temperature of from about 30° C. to about 80° C., in embodiments from about 35° C. to about 70° C. In further embodiments, the combined resins utilized in the latex may have a melt viscosity of from about 10 to about 1,000,000 Pa*S at about 130° C., in embodiments from about 50 to about 100,000 Pa*S.

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 10% (first resin)/90% (second resin) to about 90% (first resin)/10% (second resin), Where the resin includes an amorphous resin and a crystalline resin, the weight ratio of the two resins may be from about 99% (amorphous resin): 1% (crystalline resin), to about 1% (amorphous resin): 90% (crystalline resin).

In embodiments the resin may possess acid groups which, in embodiments, may be present at the terminal of the resin. Acid groups which may be present include carboxylic acid groups, and the like. The number of carboxylic acid groups may be controlled by adjusting the materials utilized to form the resin and reaction conditions.

In embodiments, the resin may be a polyester resin having an acid number from about 2 mg KOH/g of resin to about 200 mg KOH/g of resin, in embodiments from about 5 mg KOH/g of resin to about 50 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

Solvent

Any suitable organic solvent may be used to dissolve the resin, for example, alcohols, esters, ethers, ketones, amines, the like, and combinations thereof, in an amount of, for example, from about 1 wt % to about 100 wt % resin, in embodiments, from about 10% to about 90%, in embodiments, from about 25% to about 85%.

In embodiments, suitable organic solvents include, for example, methanol, ethanol, propanol, isopropanol, butanol, ethyl acetate, methyl ethyl ketone, and the like, and combinations thereof. In embodiments, the organic solvent may be immiscible in water and may have a boiling point of from about 30° C. to about 120° C.

Any suitable organic solvent noted hereinabove may also be used as a phase or solvent inversion agent, and may be utilized in an amount of from about 1 wt % to about 25 wt % of the resin, in embodiments from about 5 wt % to about 20 wt %.

Neutralizing Agent

Once obtained, the resin may be mixed at an elevated temperature, with a highly concentrated base or neutralizing agent added thereto. In embodiments, the base may be a solid or added in the form of a highly concentrated solution.

In embodiments, the neutralizing agent may be used to neutralize acid groups in the resins, so a neutralizing agent herein may also be referred to as a "basic neutralization agent." Any suitable basic neutralization agent may be used in accordance with the present disclosure. In embodiments, suitable basic neutralization agents may include both inorganic basic agents and organic basic agents. Suitable basic agents may include ammonium hydroxide, potassium hydroxide, sodium hydroxide, sodium carbonate, sodium bicarbonate, lithium hydroxide, potassium carbonate, organoamines such as triethyl amine, combinations thereof, and the like.

In embodiments, a latex emulsion may be formed in accordance with the present disclosure which may also include a small quantity of water, in embodiments, de-ionized water (DIW), in amounts of from about 1% to about 10% of resin weight in embodiments, of from about 3% to about 7%, at temperatures that melt or soften the resin, of from about 0.5% to about 5%, in embodiments from about 0.7% to about 3%.

The basic agent may be utilized so that it is present in an amount of from about 0.001% by weight to 50% by weight of the resin, in embodiments from about 0.01% by weight to about 25% by weight of the resin, in embodiments from about 0.1% by weight to 5% by weight of the resin. In embodiments, the neutralizing agent may be added in the form of an aqueous solution.

A solid neutralizing agent may be added in an amount of from about 0.1 grams to about 2 grams, in embodiments from about 0.5 grams to about 1.5 grams.

Utilizing the above basic neutralization agent in combination with a resin possessing acid groups, a neutralization ratio of from about 50% to about 300% may be achieved, in embodiments from about 70% to about 200%. In embodiments, the neutralization ratio may be calculated using the following equation:

$$\text{Neutralization ratio in an equivalent amount of 10\%}\ NH_3/\text{resin (g)}/\text{resin acid value}/0.303*100.$$

As noted above, the basic neutralization agent may be added to a resin possessing acid groups. The addition of the basic neutralization agent may thus raise the pH of an emulsion including a resin possessing acid groups from about 5 to about 12, in embodiments, from about 6 to about 11. The neutralization of the acid groups may, in embodiments, enhance formation of the emulsion.

Surfactants

In embodiments, the process of the present disclosure may include adding a surfactant to the resin, before or during the mixing at an elevated temperature, thereby enhancing formation of the phase inversed emulsion. In embodiments, the surfactant may be added prior to mixing the resin at an elevated temperature. In embodiments, the surfactant may be added before, during, or after the addition of the basic agent. In embodiments, the surfactant may be added after heating with the addition of water to form the phase inversed latex. Where utilized, a resin emulsion may include one, two, or more surfactants. The surfactants may be selected from ionic surfactants and nonionic surfactants. Anionic surfactants and cationic surfactants are encompassed by the term "ionic surfactants." In embodiments, the surfactant may be added as a solid or as a highly concentrated solution with a concentration of from about 10% to about 100% (pure surfactant) by weight, in embodiments, from about 15% to about 75% by weight. In embodiments, the surfactant may be utilized so that it is present in an amount of from about 0.01% to about 20% by weight of the resin, in embodiments, from about 0.1% to about 10% by weight of the resin, in other embodiments, from about 1% to about 8% by weight of the resin. In embodiments, the surfactant may be added as a solid of from about 1 grams to about 20 grams, in embodiments, of from about 3 grams to about 12 grams.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC PE/F, in embodiments SYNPERONIC PE/F 108. Combinations of these surfactants and any of the foregoing nonionic surfactants may be utilized in embodiments.

Anti-Foam Agent/Defoamer

In embodiments, the process of the present disclosure may include adding an anti-foam agent or defoamer to the phase inversed or resin mixture. Foam control improves the efficiency and economics for making polyester dispersions. Defoamers may be used to suppress the formation and trapping of foams (air bubbles) during formation of the polyester. In embodiments, the silicone-free anti-foam agent may be added to the resin mixture in amounts of from about 325 ppm to about 2500 ppm based on dry resin amount in embodiments from about 500 ppm to about 2000 ppm based on dry resin amount.

In embodiments, defoamers may be made of highly hydrophobic substances, for example, mineral and silicone oils. Although silicone oil may be used as a defoamer, the presence of silicone oil may have detrimental effects on eventual toner performances. Therefore, the choice of defoamer for polyester dispersions may be limited to silicone-free types. Suitable anti-foam agents which may be utilized for the processes and toners of the present disclosure may include any liquid hydrocarbon byproducts of petroleum such as for example, mineral oil.

In embodiments, suitable anti-foam agents which may be utilized may include hydrogenated and non-hydrogenated vegetable oils extracted from plants, including coconut oil, corn oil, cottonseed oil, olive oil, palm oil, rapeseed oil, almond oil, cashew oil, hazelnut oil, macadamia oil, mongongo oil, pine nut oil, pistachio oil, walnut oil, bottle gourd oil, buffalo gourd oil, pumpkin seed oil, watermelon seed oil, acai oil, blackcurrant seed oil, borage seed oil, evening primrose oil, carob pod oil, amaranth oil, apricot oil, apple seed oil, argan oil, artichoke oil, avocado oil, babassu oil, ben oil, borneo tallow nut oil, cape chestnut oil, cocoa butter, algaroba oil, cocklebur oil, poppyseed oil, cohune oil, dika oil, false flax oil, flax seed oil, grape seed oil, hemp oil, kapok seed oil, lallemantia oil, marula oil, meadowfoam seed oil, mustard oil, nutmeg butter, nutmeg oil, okra seed oil (hibiscus seed oil), papaya seed oil, perilla seed oil, pequi oil, pine nut oil, poppyseed oil, prune kernel oil, quinoa oil, ramtil oil, rice bran oil, royle oil, sacha inchi oil, tea oil (camellia oil), thistle oil, tomato seed oil, and wheat germ oil, combinations thereof, and the like.

In embodiments, suitable anti-foam agents or defoamers which may be utilized for the processes and toners of the present disclosure include low-molecular-weight oligometric-type hydrophobic homo- and co-polymers made of ethers, vinyl ethers, esters, vinyl esters, ketones, vinylpyridine, vinypyrrolidone, fluorocarbons, amides and imides, vinyllidene chlorides, styrenes, carbonates, vinyl acetals and acrylics, combinations thereof, and the like.

In embodiments, upon mixing with aqueous solutions, the defoamer may form small droplets and spontaneously spread over aqueous films at the air/water interface of bubbles (part of the foam). The defoamer droplets quickly spread over the film layer and, coupled with strong de-wetting actions, thin out the film layer, causing the film to rupture. To facilitate such film rupture, micron-sized hydrophobic fumed silica particles may often be added to a defoamer formulation. Hydrophobic silica particles may congregate in the air/water interface along with the oil droplets. As the film layer thins out by spreading oil droplets, sharp irregular silica particles may help pierce the film and the foam as a whole. The combination of hydrophobic oil and solid silica particle may thus increase the overall defoaming potency.

The amount of anti-foam agent present in the toner particles is from about 0.001 wt % to about 0.1 wt %, in embodiments, from about 0.003 wt % to about 0.06 wt %, in other embodiments, from about 0.005 wt % to about 0.04 wt %.

In embodiments, an anti-foam agent may include, for example, TEGO FOAMEX 830™, commercially available from Evonik Co, which includes mineral-oil with dispersed micron-sized silica particles having their surfaces modified with hydrophobic polyether molecules. In embodiments, the total weight of silica particles in the defoamer formulation may be less than about 3%. Both mineral oil and silica particles may help control foam formation. In addition, mineral oil may also be partially distilled out during the course of distillation, alleviating its potential impacts on toner particles. Such defoamers may potentially help suppress foaming and may permit a much more efficient solvent stripping in PIE by vacuum distillation. Accordingly, the overall distillation process may also proceed more calmly and cleanly without forming thick and long-life foams, reducing product loss due to foam boil-over and wall splashing.

Processing

As noted above, the present process includes mixing at least one resin at an elevated temperature, in the presence of an organic solvent. More than one resin may be utilized. The resin may be an amorphous resin, a crystalline resin, or a combination thereof. In embodiments, the resin may be an amorphous resin and the elevated temperature may be a temperature above the glass transition temperature of the resin. In other embodiments, the resin may be a crystalline resin and the elevated temperature may be a temperature above the melting point of the resin. In further embodiments, the resin may be a mixture of amorphous and crystalline resins and the temperature may be above the glass transition temperature of the mixture.

Thus, in embodiments, the process of making the emulsion may include contacting at least one resin with an organic solvent, heating the resin mixture to an elevated temperature, stirring the mixture, and, while maintaining the temperature at the elevated temperature, adding a solvent inversion agent to the resin mixture to dilute the mixture to a desired concentration, adding a neutralizing agent to neutralize the acid groups of the resin, and adding water dropwise into the mixture until phase inversion occurs to form a phase inversed latex emulsion. In embodiments, an anti-foam agent or defoamer is added to the phase inversed resin mixture. In embodiments, the silicone-free anti-foam agent is incrementally added to the resin mixture.

In the phase inversion process, the amorphous and/or crystalline polyester resin may be dissolved in a low boiling organic solvent, which solvent is immiscible in water, such as ethyl acetate, methyl ethyl ketone, or any other solvent noted hereinabove, at a concentration of from about 1 wt % to about 75 wt % of resin in solvent in embodiments from about 5 wt % to about 60 wt %. The resin mixture is then heated to a temperature of about 25° C. to about 90° C., in embodiments from about 30° C. to about 85° C. The heating need not be held at a constant temperature, but may be varied. For example, the heating may be slowly or incrementally increased during heating until a desired temperature is achieved.

While the temperature is maintained in the aforementioned range, the solvent inversion agent may be added to the mixture. The solvent inversion agent, such as an alcohol like isopropanol, or any other solvent inversion agent noted hereinabove, in a concentration of from about 1 wt % to about 25 wt % of the resin, in embodiments from about 5 wt % to about 20 wt %, may be added to the heated resin mixture, followed by the dropwise addition of water, or optionally an alkaline base, such as ammonia, until phase inversion occurs (oil in water).

The aqueous alkaline composition and optional surfactant may be metered into the heated mixture at least until phase inversion is achieved. In other embodiments, the aqueous alkaline composition and optional surfactant may be metered into the heated mixture, followed by the addition of an aqueous solution, in embodiments deionized water, until phase inversion is achieved.

In embodiments, a continuous phase inversed emulsion may be formed. Phase inversion can be accomplished by continuing to add an aqueous alkaline solution or basic agent, optional surfactant and/or water compositions to create a phase inversed emulsion including a disperse phase including droplets possessing the molten ingredients of the resin composition, and a continuous phase including the surfactant and/or water composition.

In embodiments, a process of the present disclosure may include heating one or more ingredients of a resin composition to an elevated temperature, stirring the resin composition, and, while maintaining the temperature at the elevated temperature, adding the base or neutralizing agent, optionally in an aqueous alkaline solution, and optional surfactant into the mixture to enhance formation of the emulsion including a disperse phase and a continuous phase including the resin composition, and continuing to add the aqueous alkaline solution, optional surfactant and/or water until phase inversion occurs to form the phase inversed emulsion.

As noted above, in accordance with the present disclosure, a neutralizing agent may be added to the resin after it has been melt mixed. The addition of the neutralizing agent may be useful, in embodiments, where the resin utilized possesses acid groups. The neutralizing agent may neutralize the acidic groups of the resin, thereby enhancing the formation of the phase-inversed emulsion and formation of particles suitable for use in forming toner compositions.

Prior to addition, the neutralizing agent may be at any suitable temperature, including room temperature of from about 20° C. to about 25° C., or an elevated temperature, for example, the elevated temperature mentioned above.

In embodiments, the neutralizing agent may be added at a rate of from about 0.01% wt % to about 10 wt % every 10 minutes, in embodiments from about 0.5 wt % to about 5 wt % every 10 minutes, in other embodiments from about 1 wt % to about 4 wt % every 10 minutes. The rate of addition of the neutralizing agent need not be constant, but can be varied.

In embodiments, where the process flurther includes adding water after the addition of basic neutralization agent and optional surfactant, the water may be metered into the mixture at a rate of about 0.01 wt % to about 10 wt % every 10 minutes, in embodiments from about 0.5 wt % to about 5 wt % every 10 minutes, in other embodiments from about 1 wt % to about 4 wt % every 10 minutes. The rate of water addition need not be constant, but can be varied.

Although the point of phase inversion may vary depending on the components of the emulsion, the temperature of heating, the stirring speed, and the like, phase inversion may occur when basic neutralization agent, optional surfactant, and/or water has been added so that the resulting resin is present in an amount from about 5 wt % to about 70 wt % by weight of the emulsion, in embodiments from about 20 wt % to about 65 wt % by weight of the emulsion, in other embodiments from about 30 wt % to about 60 wt % by weight of the emulsion.

In embodiments, a silicone free anti-foam agent may be added to the resin mixture to lessen the amount of foam formed during the phase inversion process. In embodiments, the defoamer may reduce the distillation time significantly as described hereinbelow.

As noted hereinabove, defoamer may achieve its best results when applied incrementally to the resin mixture. In embodiments, the defoamer is metered into the resin mixture. The defoamer may be metered into the mixture at a rate of about 5 wt % to about 100 wt % every 1 minute, in embodiments from about 10 wt % to about 75 wt % every 1 minute, in other embodiments from about 25 wt % to about 55 wt % every 1 minute. The rate of defoamer addition need not be constant, but can be varied.

In embodiments, distillation with stirring of the organic solvent is performed to provide resin emulsion particles with an average diameter size of, for example, in embodiments from about 50 nm to about 250 nm, in other embodiments from about 120 to about 180 nanometers.

At phase inversion, the resin particles become emulsified and dispersed within the aqueous phase. That is, an oil-in-water emulsion of the resin particles in the aqueous phase is formed. Phase inversion may be confirmed by, for example, measuring via any of the techniques within the purview of those skilled in the art.

Phase inversion may permit formation of the emulsion at temperatures avoiding premature crosslinking of the resin of the emulsion.

Stirring may be utilized to enhance formation of the phase inversed emulsion. Any suitable stirring device may be utilized. The stirring need not be at a constant speed, but may be varied. For example, as the heating of the mixture becomes more uniform, the stirring rate may be increased. In embodiments, the stirring may be at from about 10 revolutions per minute (rpm) to about 5,000 rpm, in embodiments from about 20 rpm to about 2,000 rpm, in other embodiments from about 50 rpm to about 1,000 rpm. In embodiments, a homogenizer (that is, a high shear device), may be utilized to form the phase inversed emulsion, but in other embodiments, the process of the present disclosure may take place without the use of a homogenizer. Where utilized, a homogenizer may operate at a rate of from about 3,000 rpm to about 10,000 rpm.

In embodiments, the preparation of polyester emulsions of the present disclosure may include dissolution of at least one resin in at least one organic solvent, heating the mixture to an elevated temperature, neutralization using a neutralizing agent, its inversion through mixing with a solvent inversion agent and water, introducing an anti-foam agent in the resin mixture and finally distillation of the solvent from the emulsion. This process offers several advantages over current solvent-based processes for the formation of emulsions both at the laboratory and industrial scale.

In embodiments, the anti-foam agent or defoamer may reduce the total solvent distillation time of from about 30 hours to about 8 hours, in embodiments, of from about 26 hours to about 10 hours, and in other embodiments, of from about 23 hours to about 12 hours. Without defoamer, distillation time may be from about 24 hours to about 32 hours, in embodiments of from about 26 hours to about 30 hours. With defoamer, distillation time may be of from about 5 hours to about 10 hours, in embodiments of from about 7 hours to about 9 hours.

The process of the present disclosure for the production of polyester latex emulsions using PIE permits high throughput experimental screening, high throughput production rates, eliminates or minimizes wasted product, greatly reduces time to market for the latex production, and produces latexes with more efficient solvent stripping.

Following phase inversion, additional surfactant, water, and/or aqueous alkaline solution may optionally be added to dilute the phase inversed emulsion, although this is not required. Following phase inversion, the phase inversed emulsion may be cooled to room temperature, for example from about 20° C. to about 25° C.

The emulsified resin particles in the aqueous medium may have a submicron size, for example of about 1 μm or less, in embodiments about 500 nm or less, such as from about 10 nm to about 500 nm, in embodiments from about 50 nm to about 400 nm, in other embodiments from about 100 nm to about 300 nm, in some embodiments about 200 nm. Adjustments in particle size can be made by modifying the ratio of water to resin flow rates, the neutralization ratio, solvent concentration, and solvent composition.

In accordance with the present disclosure, it has been found that the processes herein may produce emulsified resin particles that retain the same molecular weight properties of the starting resin, including equivalent charging and fusing performance. Utilization of a defoamer in the processes and toners of the present disclosure may result in from about 30% to about 75% of savings in cycle time and energy for polyester phase inversion emulsification including savings in equipment by using only one reactor as compared to a two-reactor process.

The polyester emulsions may also have a high product yield by reducing reactor fouling and increasing reactor loading. Accordingly, a clean polyester dispersion with less residual solvents is produced.

Toner

The emulsion thus formed as described above may be utilized to form toner compositions by any method within the purview of those skilled in the art. The latex emulsion may be contacted with a colorant, optionally in a dispersion, and other additives to form a toner by a suitable process, in embodiments, an emulsion aggregation and coalescence process.

In embodiments, the optional additional ingredients of a toner composition including colorant, wax, and other additives may be added before, during or after the melt mixing the resin to form the latex. The additional ingredients may be added before, during or after the formation of the latex emulsion, wherein the neutralized resin is contacted with water. In further embodiments, the colorant may be added before the addition of the surfactant.

Toners produced in accordance with the present disclosure may possess excellent charging characteristics when exposed to extreme relative humidity (RH) conditions. The low-humidity zone (C-zone) may be about 10° C./15% RH, while the high humidity zone (A-zone) may be about 28° C./85% RH. In embodiments, charge distribution (q/d) of the toners of the present disclosure may be from about −3 mm to about 15 mm, in embodiments from about −5 to about 12 mm, in other embodiments from about −7.5 mm to about −10.5 mm. Toners of the present disclosure may possess a parent toner charge per mass ratio (Q/M) in ambient conditions (B-zone) of about 21° C./50% RH of from about 25 μC/g to about 65 μC/g, in embodiments from about 30 μC/g to about 60 μC/g, in other embodiments from about 35 μC/g to about 50 μC/g.

Colorants

As the colorant to be added, various known suitable colorants, such as dyes, pigments, mixtures of dyes, mixtures of pigments, mixtures of dyes and pigments, and the like, may be included in the toner. In embodiments, the colorant may be included in the toner in an amount of, for example, about 0.1 to about 35% by weight of the toner, or from about 1 to about 15% by weight of the toner, or from about 3 to about 10% by weight of the toner.

As examples of suitable colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosures.

In embodiments, a pigment or colorant may be employed in an amount of from about 1% by weight to about 35% by weight of the toner particles on a solids basis, in other embodiments, from about 5% by weight to about 25% by weight.

Wax

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1% by weight to about 25% by weight of the toner particles, in embodiments from about 5% by weight to about 20% by weight of the toner particles.

When a wax dispersion is used, the wax dispersion may include any of the various waxes conventionally used in emulsion aggregation toner compositions. Waxes that may be selected include waxes having, for example, an average molecular weight of from about 500 to about 20,000, in embodiments from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as camauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, the present disclosure provides processes for producing toner particles with an anti-foam agent having a more efficient distillation time. In embodiments, a process of the present disclosure includes melt mixing at least one resin at an elevated temperature in the presence of an organic solvent as discussed above; optionally adding a surfactant either before, during or after melt mixing the resin; optionally adding one or more additional ingredients of a toner composition such as colorant, wax, and other additives; adding a solvent inversion agent, a basic agent, water, and an anti-foam agent; performing a phase inversion to create a phase inversed emulsion including a disperse phase comprising toner-sized droplets including the molten resin and the optional ingredients of the toner composition; and solidifying the toner-sized droplets to result in toner particles.

In embodiments, the optional additional ingredients of a toner composition including colorant, wax, and other additives may be added before, during or after the melt mixing the resin. The additional ingredients can be added before, during or after the addition of the optional surfactant. In further embodiments, the colorant may be added before the addition of the optional surfactant.

In embodiments, the mixture of components are present in an amount of from about 5 wt % to about 25 wt % of crystalline resin, about 60 wt % to about 90 wt % of amorphous resin, about 3 wt % to about 15 wt % of colorant, and optionally from about 5 wt % to about 15 wt % of a wax dispersion, and wherein the total weight percent of all components is 100 wt % of the toner. The amount of optional anionic surfactant utilized is from about 0 wt % to about 3 wt % of the toner, but not included in the total weight percent of the toner since the surfactant is usually eventually removed from the toner composite by washing.

Toner-sized" indicates that the droplets have a size comparable to toner particles used in xerographic printers and copiers, wherein "toner sized" in embodiments indicates a volume average diameter of, for example, from about 2 μm to about 25 μm, in embodiments from about 3 μm to about 15 μm, in other embodiments from about 4 μm to about 10 μm. As it may be difficult to directly measure droplet size in the emulsion, the droplet size in the emulsion may be determined by solidifying the toner-sized droplets and then measuring the resulting toner particles.

Because the droplets may be toner-sized in the disperse phase of the phase inversed emulsion, in embodiments there may be no need to aggregate the droplets to increase the size thereof prior to solidifying the droplets to result in toner particles. However, such aggregation/coalescence of the droplets is optional and can be employed in embodiments of the present disclosure, including the aggregation/coalescence techniques described in, for example, U.S. Patent Application Publication No. 2007/0088117, the disclosure of which is hereby incorporated by reference in its entirety.

In embodiments, toner compositions may be prepared by emulsion aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent such as polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, and the like, and mixtures thereof.

Other suitable aggregating agents also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the aggregating agent is a polyion aggregating agent, the agent may have any desired number of polyion atoms present. For example, in embodiments, suitable polyaluminum compounds have from about 2 to about 13, in other embodiments, from about 3 to about 8, aluminum ions present in the compound.

The aggregating agent may be added to the mixture utilized to form a toner in an amount of, for example, from about 0% to about 10% by weight, in embodiments from about 0.2% to about 8% by weight, in other embodiments from about 0.5% to about 5% by weight, of the resin in the mixture. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a resin coating may be applied to the aggregated particles to form a shell thereover. Any resin described above as suitable for forming the core resin may be utilized as the shell. In embodiments, a polyester amorphous resin latex as described above may be included in the shell.

In embodiments, resins which may be utilized to form a shell include, but are not limited to, a crystalline resin latex described above, and/or the amorphous resins described above that may be formed by the phase inversion emulsification processes of the present disclosure. In embodiments, an amorphous resin which may be utilized to form a shell in accordance with the present disclosure includes an amorphous polyester, optionally in combination with a crystalline polyester resin latex described above. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins, optionally the solvent free crystalline polyester resin latex neutralized with piperazine described above, may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C., which may be at or above the glass transition temperature of the resins utilized to form the toner particles, and/or reducing the stirring, for example to from about 100 rpm to about 1,000 rpm, in embodiments from about 200 rpm to about 800 rpm. Higher or lower temperatures may be used, it being understood that the temperature is a function of the resins used for the binder. Coalescence may be accomplished over a period of from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10% by weight of the toner, in embodiments from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1% by weight to about 5% by weight of the toner, in embodiments of from about 0.25% by weight to about 3% by weight of the toner. In embodiments, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000 and 6,214,507, the disclosures of each of which are hereby incorporated by reference in their entirety.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

A 2 L-scale phase inversion emulsification (PIE) process was developed for screening of defoamer efficiency. About 100 grams of a silicone free viscous liquid defoamer, TEGO FOAMEX 830™, commercially available from Evonik Co., was utilized for initial lab screening of defoamer efficiency in PIE process across a wide range of defoamer dose levels. About 10 wt % of a high molecular-weight amorphous polyester resin, about 6.9 wt % of methyl ethyl ketone (MEK) and about 1.5 wt % of 2-Propanol (IPA) were added to a glass reaction vessel, heated up to about 45° C., and allowed to dissolve with stirring for about 2 hours. About 1 ml of a 3.5M sodium hydroxide (NaOH) aqueous solution was then added dropwise to this resin solution and the combination was left to stir for about 10 minutes at a temperature of about 40° C. De-ionized water (DIW), heated to about 40° C. via a heat exchanger, was fed to the neutralized resin by a metering pump, (i.e. a Knauer pump) over about a 2 hour period.

Thereafter, a prescribed amount of TEGO FOAMEX 830™ was added to the reactor vessel. Defoamer dose level varied from about 325 ppm, 500 ppm, 625 ppm, and about 2500 ppm (based on dry resin amount).

The temperature of the reactor was then set to about 55° C. and a vacuum was slowly applied to the reactor and increased to about 27 Hg after 30 minutes.

TABLE 1

Comparison of Parent Particle Formation Process

| | D50v | GSDn | GSDv | Circ. |
|---|---|---|---|---|
| No-defoamer | 5.56 | 1.23 | 1.18 | 0.980 |
| With defoamer | 5.60 | 1.23 | 1.18 | 0.981 |

The characteristics of the toner particles may be determined by any suitable technique and apparatus. Volume average particle diameter $D_{50v}$, GSDv, and GSDn was measured by means of a measuring instrument such as a Beckman Coulter Multisizer 3, operated in accordance with the manufacturer's instructions. Representative sampling occured as follows: a small amount of toner sample, about 1 gram, was obtained and filtered through a 25 micrometer screen, then put in isotonic solution to obtain a concentration of about 10%, with the sample then run in a Beckman Coulter Multisizer 3. Circularity was measured with, for example, a Sysmex FPIA 2100 analyzer.

Particles made from doped polyester dispersion were further converted to toner particles with additives and evaluated. The results are listed below in Table 2, and compared with toner having no defoamer. The toner properties for particles made with defoamer-doped dispersions were found to be comparable to those of toners without defoamer.

TABLE 2

Comparison of Toner Particle Properties

| | C Zone (10° C./15% RH) | | A Zone (28° C./85% RH) | | Targets | |
|---|---|---|---|---|---|---|
| Toner ID | (4 mm-11 mm) q/d (mm) | q/m (uC/g) | (4 mm-11 mm) q/d (mm) | q/m (uC/g) | >80% A-Zone Charge Maintenance (24 h) | <10% Heat Cohesion @ 51° C./50% RH |
| No-defoamer | −10.0 | 43 | −6.0 | 26 | 81 | 6.5 |
| With defoamer | −10.5 | 50 | −7.5 | 35 | 71 | 10.3 |

In all the different dose levels studied, the defoamer was effective in eliminating foams and saving time during vacuum distillation. For example, it took about 2 hours to strip MEK/IPA down to 20 ppm, when utilizing about 625 ppm of defoamer, whereas without a defoamer, vacuum distillation took up to about 3.5 hours.

Example 2

Emulsion Aggregation (EA) Particle formation and toner properties. A polyester dispersion was doped with about 600 ppm of TEGO FOAMEX 830™ and converted to particles in a 20-gallon reactor using an EA particle process. The doped polyester dispersion of Example 1 comprised the same characteristics as that of a normal polyester dispersion without defoamer, as shown below in Table 1. Specifically, toner particles having no defoamer and toner particles having defoamer possessed very similar properties, including volume average particle diameter (D50v), Number Average Geometric Size Distribution (GSDn), Volume Average Geometric Size Distribution (GSDv), and Circularity (Circ.).

Toners produced in accordance with the present disclosure possessed excellent charging characteristics when exposed to extreme relative humidity (RH) conditions. As shown above, the low-humidity zone (C-zone) may be about 10° C./15% RH, while the high humidity zone (A-zone) may be about 28° C./85% RH. In embodiments, charge distribution (q/d) of the toners of the present disclosure was from about −7.5 mm to about 10.5 mm. Toners of the present disclosure possessed a parent toner charge per mass ratio (Q/M) in ambient conditions (B-zone) of about 21° C./50% RH of from about 35 μC/g to about 50 μC/g.

It is desirable to have a toner with low cohesion to enable effective toner flow. Inventive and comparative toners were tested in a Hosokawa Powder Flow Tester by using a set of 53 (A), 45 (B) and 38 (C) micron screens stacked together, with the weight of the screens recorded before adding to the top screen about 2 grams of toner, with the vibration time set to 90 seconds at about 1 mm vibration. After vibration, the screens were removed and weighed to determine the weight of toner (weight after—weight before—weight retained toner). % Cohesion was calculated by the following formula:

$$\% \text{ Cohesion} = (R_1/T_i) \times 100\% + (R_2/T_i) \times 60\% + (R_3/T_i) \times 20\%$$

wherein $R_1$, $R_2$ and $R_3$ are the amounts of toner retained in screens A, B and C, respectively, and $T_i$ is the initial amount of toner.

As is shown in the Table 2 above, it was observed that the addition of the defoamer provided a desirable toner with low cohesion, i.e. decreased particle to particle cohesion. That is, the toner flow properties of toners of the present disclosure were equivalent to the prior art toner with no defoamer.

Example 3

PIE process with a low molecular-weight crystalline polyester resin, FXC42, in 30 gallon reactor with defoamer. A low molecular-weight crystalline polyester resin, FXC42 was emulsified by a typical PIE process in a 30 gallon reactor as follows. About 10 wt % of a FXC42 crystalline polyester resin, about 5 wt % of methyl ethyl ketone (MEK) and about 0.65 wt % of 2-Propanol (IPA) were added to a glass reaction vessel, heated up to about 45° C., and allowed to dissolve with stirring for about 2 hours. About 60 ml of a 3.5M sodium hydroxide (NaOH) (Neutralization Ratio (NR) of 75%) aqueous solution was then added dropwise to this resin solution and the combination was left to stir for about 10 minutes at a temperature of about 40° C. About 30 wt % DIW, heated to about 40° C. via a heat exchanger, was fed to the neutralized resin by a metering pump, (i.e. a Knauer pump) over about a 2 hour period.

During vacuum distillation, the reactor was reheated with ajacket set point of about 60° C. About 500 ppm of defoamer, i.e. TEGO FOAMEX 830™, was added to the reactor by opening the loading port. Once the reactor temperature reached about 58° C., a vacuum was slowly applied to the reactor and a vacuum of about 74 mm of Hg was reached in the reactor after about 36 minutes. Distillation was initially fast and the temperature in the reactor was then dropped from about 58° C. to about 45.2° C. Another charge of about 500 ppm of defoamer was then added and full vacuum was obtained almost instantly. The total time to reach the specification of residual solvents of less than about 50 ppm was about 3 hours. The total distillation time for the crystalline resin solution reduced from about 4.5 hours to about 3.25 hours.

Example 4

PIE process with amorphous high molecular-weight polyester resin, FXC56, in 30-gallon reactor with defoamer. A polyester was produced as in Example 3 above, except high molecular weight crystalline polyester resin, FXC56, was used as the resin instead of FXC42.

During vacuum distillation, the reactor was reheated with a jacket set point of about 60° C. Once the reactor temperature reached about 56.4° C., the vacuum was slowly applied to the reactor and a vacuum of about 116 mm of Hg was achieved after about 45 minutes. Distillation was fast initially and the temperature in the reactor was dropped from about 56.4° C. to about 44.5° C. Distillation slowed down and the vacuum could not be increased. Thereafter, about 500 ppm of defoamer was added to the mixture through a charge line on top of the reactor. Pressure in the reactor was dropped from about 116 mm of Hg to about 28 mm of Hg (full vacuum) in about 5 minutes. The total time to reach the residual solvent specification was about 3 hours and 20 minutes (vs. 6 hours without defoamer). The total distillation time for the crystalline polyester resin solution reduced from about 5.6 hrs to about 3.75 hrs.

Example 5

EA particle formation. The polyester dispersions of Examples 3 and 4 were converted to particles in a 20-gallon reactor using standard mainline EA particle processes as described above. The average defoamer level in the polyester dispersions was about 750 ppm. The overall particle process showed no significant differences from EA processes, as shown below in Table 3. Specifically, toner particles having no defoamer and toner particles having defoamer possessed very similar properties for volume average particle diameter (D50v), Number Average Geometric Size Distribution (GSDn), Volume Average Geometric Size Distribution (GSDv), and Circularity (Circ.).

TABLE 3

Comparison of Parent Particle Properties

| | D50v | GSDn | GSDv | Circ. | C-Zone Charge q/m (uC/g) | A-Zone Charge q/m uC/g) | C/Z Charge ratio |
|---|---|---|---|---|---|---|---|
| No-defoamer | 5.56 | 1.23 | 1.18 | 0.980 | 44 | 29 | 1.52 |
| With defoamer | 5.50 | 1.22 | 1.19 | 0.979 | 49 | 36 | 1.36 |

As illustrated in Table 3, the toner of the present disclosure was quite similar to the control toner that did not contain defoamer for preferred gloss performance. Under high humidity, high temperature conditions (A-Z) that disfavor triboelectification of the toner against the carrier, the toner of the present disclosure showed slightly greater charge than the control toner. Under low humidity, low temperature conditions (C-Z) that favor triboelectrification, the toner of the present disclosure showed slightly greater charge than the control toner. Thus, from the standpoint of triboelectrification, toners of the present disclosure with defoamer provided equivalent performance to conventional toners.

Example 6

PIE process with high molecular-weight crystalline polyester resin, FXC56, in 300-gallon reactor and defoamer. High molecular weight crystalline polyester resin, FXC56, was converted to aqueous dispersion using a standard PIE process in a 300-gallon reactor, During vacuum distillation, four small portions of defoamer were added in different stages to control foam conditions inside the reactor, with total amount of defoamer of about 700 ppm. Foaming was well controlled and distillation was completed in 8 hours compared with 30 hours process time when no defoamer was used.

Example 7

EA particle formation. The high molecular weight polyester dispersion was converted to particles in a 20-gallon reactor using standard mainline EA particle processes as discussed above in toner preparation. Overall, the toner particles with defoamer showed no differences from toner particles without defoamer, as shown below in Table 4. Specifically, toner particles having no defoamer and toner particles having defoamer possessed very similar properties for volume average particle diameter (D50v), Number Average Geometric Size Distribution (GSDn), Volume Average Geometric Size Distribution (GSDv), and Circularity (Circ.).

TABLE 4

Comparison of Parent Particle Formation

| | D50v | GSDn | GSDv | Circ. |
|---|---|---|---|---|
| No-defoamer | 5.46 | 1.22 | 1.19 | 0.978 |
| With defoamer | 5.50 | 1.22 | 1.19 | 0.979 |

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process for preparing a toner resin emulsion comprising:

contacting at least one resin with an organic solvent to form a resin mixture;

optionally adding a surfactant to said mixture;

heating the resin mixture;

adding at least one solvent inversion agent to the mixture;

neutralizing the resin mixture with a neutralizing agent; and introducing a silicone-free anti-foam agent comprising a hydrophobic oil possessing micron-sized silica particles dispersed therein to the resin mixture to form a toner resin emulsion.

2. The process according to claim 1, wherein the at least one resin is selected from the group consisting of amorphous resins, crystalline resins, and combinations thereof.

3. The process according, to claim 1, wherein the neutralizing agent is added in the form of an aqueous solution selected from the group consisting of ammonium hydroxide, potassium hydroxide, sodium hydroxide, sodium carbonate, sodium bicarbonate, lithium hydroxide, potassium carbonate, organoamines, and combinations thereof, and raises the pH of the resin mixture to from about 5 to about 12.

4. The process according to claim 1, wherein the micron-sized silica particles have a surface modified with a hydrophobic polyether molecule, in an amount of from about 325 ppm to about 2500 ppm based on dry weight of the resin, wherein the hydrophobic oil is selected from the group consisting of mineral oil, coconut oil, corn oil, cottonseed oil, olive oil, palm oil, rapeseed oil, almond oil, cashew oil, Hazelnut oil, macadamia oil, mongongo oil, pine nut oil, pistachio oil, walnut oil, bottle gourd oil, buffalo gourd oil, pumpkin seed oil, watermelon seed oil, acai oil, blackcurrant seed oil, borage seed oil, evening primrose oil, carob pod oil, amaranth oil, apricot oil, apple seed oil, argan oil, artichoke oil, avocado oil, babassu oil, ben oil, borneo tallow nut oil, cape chestnut oil, cocoa butter, algaroba oil, cocklebur oil, poppyseed oil, cohune oil, dika oil, false flax oil, flax seed oil, grape seed oil, hemp oil, kapok seed oil, lallemantia oil, marula oil, meadowfoam seed oil, mustard oil, nutmeg butter, nutmeg oil, okra seed oil, papaya seed oil, perilla seed oil, pequi oil, prune kernel oil, guinea oil, ramtil oil, rice bran oil, royle oil, sachainchi oil, comellia oil, thistle oil, tomato seed oil, wheat germ oil, and combinations thereof.

5. The process according to claim 1, wherein the resin mixture is heated to a temperature of from about 25° C. to about 90° C.

6. The process in accordance with claim 1, wherein the organic solvent is selected from the group consisting of an alcohol, ester, ether, ketone, an amine, and combinations thereof, in an amount of from about 10 wt % to about 60 wt % of the polyester resin.

7. The process of claim 1, further comprising: following the neutralizing step, adding water to the neutralized resin mixture until phase inversion occurs.

8. The process according to claim 1, wherein the at least one resin comprises a polyester resin.

9. The process according to claim 1, further comprising after adding the anti-foam agent, removing the solvent.

10. The process according to claim 1 wherein the solvent inversion agent is an alcohol selected from the group consisting of methanol, ethanol, propanol, butanol, pentanol, ethylene glycol, propylene glycol, and combinations thereof, in an amount of from about 1 wt % to about 25 wt % of the polyester resin.

* * * * *